US007969098B2

(12) United States Patent
Yeh

(10) Patent No.: US 7,969,098 B2
(45) Date of Patent: Jun. 28, 2011

(54) DIMMING CIRCUIT FOR DISCHARGING LAMP CAPABLE OF TURNING OFF UNDER A LOW POWER CONDITION

(75) Inventor: Chao-Chin Yeh, Changhwa County (TW)

(73) Assignee: Chuan Shih Industrial Co., Ltd., Changhwa Country (TW)

( * ) Notice: Subject to any disclaimer, the term of this patent is extended or adjusted under 35 U.S.C. 154(b) by 422 days.

(21) Appl. No.: 12/255,997

(22) Filed: Oct. 22, 2008

(65) Prior Publication Data

US 2010/0072914 A1 Mar. 25, 2010

(51) Int. Cl.
*H05B 39/09* (2006.01)
*H05B 39/04* (2006.01)

(52) U.S. Cl. ..... 315/200 R; 315/291

(58) Field of Classification Search ..... 315/209 R, 315/291, 307, DIG. 2, DIG. 4, DIG. 5
See application file for complete search history.

(56) References Cited

U.S. PATENT DOCUMENTS 5,563,777 A * 10/1996 Miki et al. ..... 363/37
5,619,106 A * 4/1997 Secen ..... 315/290
5,869,935 A * 2/1999 Sodhi ..... 315/225
5,914,572 A * 6/1999 Qian et al. ..... 315/307

* cited by examiner

*Primary Examiner* — Douglas W Owens
*Assistant Examiner* — Minh D A
(74) *Attorney, Agent, or Firm* — Browdy and Neimark, PLLC

(57) ABSTRACT

A dimming circuit includes a resonant unit, a rectification unit, a half-bridge output unit, a first switch device and a second switch device, and a selection unit. The rectification unit is connected to the resonant unit. The half-bridge output unit includes a first electric-controlled switch and a second electric-controlled switch in series. The first and second switch devices are connected to the first and second electric-controlled switches. The selection unit may turn on the first switch device and the second electric-controlled switch when a potential is rising that turns on the discharging lamp and turn off the second switch device and keep turning on the second switch device when the discharging lamp is lighting. The selection unit further turns on the second switch device to turn off the second electric-controlled switch for turning off the discharging lamp in a low power condition.

6 Claims, 1 Drawing Sheet

DIMMING CIRCUIT FOR DISCHARGING LAMP CAPABLE OF TURNING OFF UNDER A LOW POWER CONDITION

BACKGROUND OF THE INVENTION

1. Field of the Invention

The present invention relates to a dimmer for a discharging lamp and more particularly, to a dimming circuit, which may automatically turn off the discharging lamp in a low power condition.

2. Description of the Related Art

Typically, a conventional dimming circuit for a discharging lamp includes a control IC or a complex circuit for variable frequency function to control different power outputs that may change the brightness level of the lamp. However, the control IC and the circuit for variable frequency function are expensive that such dimmers are not popular in the market.

Besides, the conventional dimming circuit has a problem of an unstable potential in a low power condition that will cause the discharging lamp flashing. The dimming range of the dimming circuit will be affected by parameters of different models of discharging lamps that the dimming circuit may have an error dimming work in a low power condition and cause a greater flashing.

SUMMARY OF THE INVENTION

The primary objective of the present invention is to provide a dimming circuit of a discharging lamp, which may turn off the power in a low power condition to avoid flash problem.

The secondary objective of the present invention is to provide a dimming circuit of a discharging lamp, which has a simple structure and a lower cost.

To achieve the objectives of the present invention, a dimming circuit for a discharging lamp includes a resonant unit, a rectification unit, a half-bridge output unit, a first switch device and a second switch device, and a selection unit. The rectification unit is connected to the resonant unit to transfer an AC power to a DC power. The half-bridge output unit, which is connected to a discharging lamp, includes a first electric-controlled switch and a second electric-controlled switch in series. The first electric-controlled switch and the second electric-controlled switch are in series with the rectification unit, and have a control terminal respectively. The first and second switch devices are connected to the control terminals of the first and second electric-controlled switches respectively. The selection unit includes a start sub-unit and a maintain/turn-off sub-unit. The start sub-unit is connected to the rectification unit and the first switch device to turn on the first switch device and the second electric-controlled switch when a potential is rising that turns on the discharging lamp. The maintain/turn-off sub-unit is connected to the rectification unit and the second switch device to turn off the second switch device and keep turning on the second switch device when the discharging lamp is lighting. The maintain/turn-off sub-unit further turns on the second switch device to turn off the second electric-controlled switch for turning off the discharging lamp when the potential is lower than a predetermined value.

DETAILED DESCRIPTION OF THE INVENTION

Figure 1:
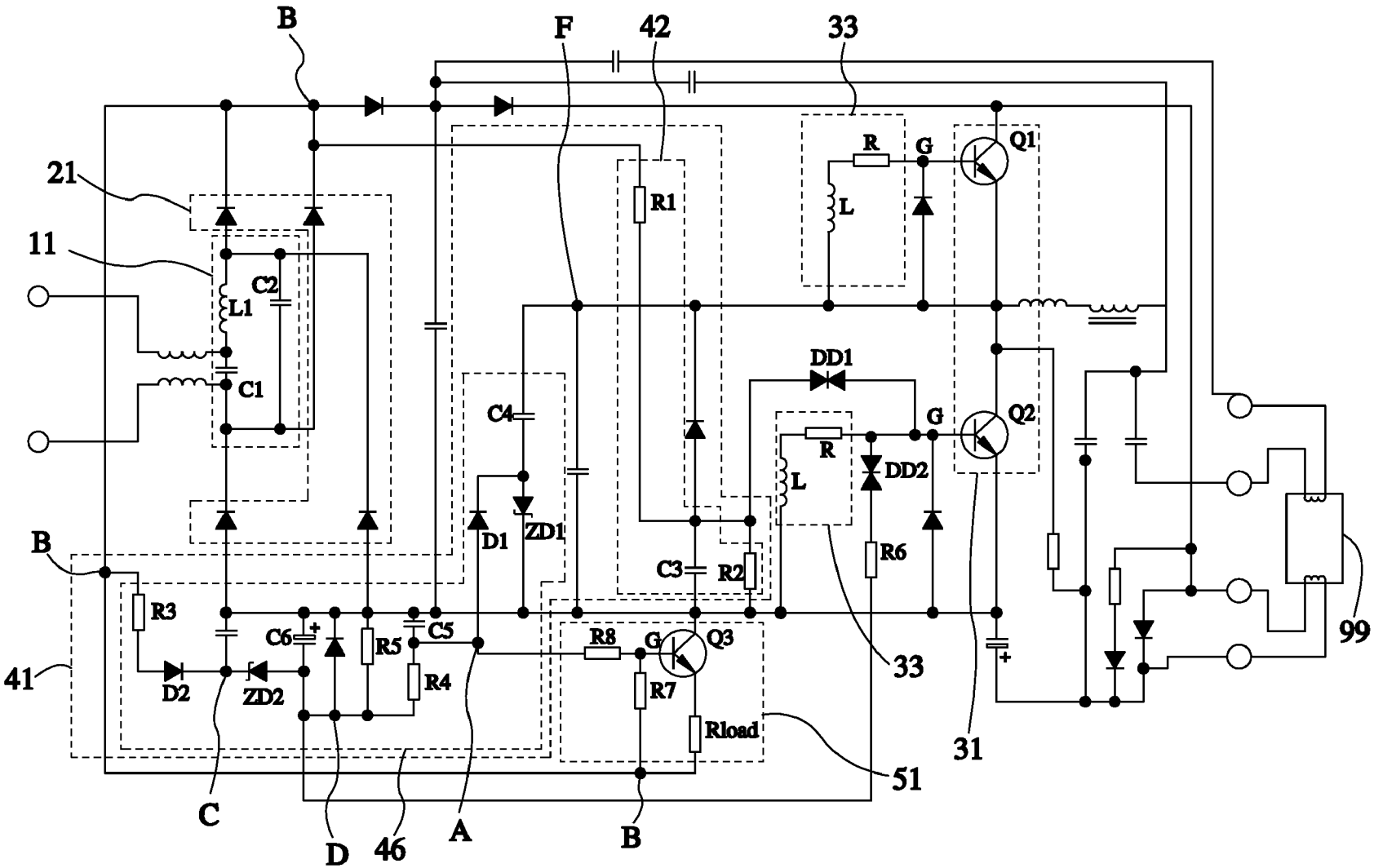
FIG. 1 is a circuit diagram of a preferred embodiment of the present invention.

FIG. 1 show a dimming circuit 10 for a discharging lamp, which includes a resonant unit 11, a rectification unit 21, a half-bridge output unit 31, a first switch device DD1, a second switch device DD2, and a selection unit 41.

The resonant unit 11 includes a first capacitance C1 and a second capacitance C2 in series, and a first inductance L1 in parallel with the first and second capacitances C1, C2.

The rectification unit 21 is a full-wave rectification circuit which is connected to the resonant unit 11 to transfer the AC power to a DC power.

The half-bridge output unit 31 includes a first electric-controlled switch Q1 and a second electric-controlled switch Q2 in series. The first and second electric-controlled switches Q1, Q2 are in series with the rectification unit 21. Each of the first and second electric-controlled switches Q1, Q2 has a control terminal G connected to an oscillation unit 33 respectively. The oscillation units 33 are RL oscillators, each of which has a resistor R and an inductance L in series. The half-bridge output unit 31 is connected to the discharging lamp 99.

The first switch device DD1 and the second switch device DD2 are diode AC switches, each of which has an end connected to the control terminal G of the second electric-controlled switch Q2.

The selection unit 41 includes a start sub-unit 42 and a maintain/turn-off sub-unit 46.

The start sub-unit 42 is connected to the rectification unit 21 and the first switch device DD1. In the present invention, the start sub-unit 42 includes a first resistor R1, a second resistor R2, and a third capacitance C3. A connection of the start unit 42 with the other elements is shown in FIG. 1. The third capacitance C3 has an end connected to ground and the other end connected to a contact point between the first resistor R1 and second resistor R2 and connected to the other end of the first switch device DD1. The start unit 42 starts up the first switch device DD1 when the potential is rising to turn on the second electric-controlled switch Q2 that may turn on the discharging lamp 99.

The maintain/turn-off sub-unit 46 is connected to the rectification unit 21 and the second switch device DD2. In the present invention, the maintain/turn-off sub-unit 46 includes a fourth capacitance C4, a first diode D1, a first zener diode a fifth capacitance C5, a third resistor R3, a second diode D2, a second zener diode ZD2, a fourth resistor R4, a fifth resistor R5, and a sixth capacitance C6. The connection of the maintain/turn-off sub-unit 46 with the other elements is shown in FIG. 1. There are a contact A is defined between the first diode D1 and the fifth capacitance C5, a contact D between the fourth resistor R4 and the fifth resistor R5, and a contact C between the second diode D2 and the second zener diode ZD2. The sixth capacitance C6 has an end connected to ground and the other end connected to the contact D. The contact D is connected to the other end of the second switch device DD2 through the sixth resistor R6. A contact F is defined between the first electric-controlled switch Q1 and the second electric-controlled switch Q2. The maintain/turn-off sub-unit 46 may maintain the second electric-controlled switch's Q2 working when the discharging lamp 99 is turned on, and the second switch device DD2 is activated unexpectedly. The maintain/turn-off sub-unit 46 also turns off the second electric-controlled switch Q2 when the potential is lower than a predetermined value and the second switch device DD2 is activated unexpectedly that may turn off the discharging lamp 99.

The dimming circuit 10 of the present invention is incorporated in a conventional standard dimmer (not shown) and connected to an AC power. The standard dimmer is connected to the resonant unit 11 to supply power. User may operate the dimmer to dimming the discharging lamp 99.

In starting procedure, the power is turned on, and the potential id rising, the current is rectified by the rectification unit 21 to charge the third capacitance C3 through the contact B and the first resistor R1 and second resistor R2 of the starting sub-unit 42. When the potential of the third capacitance C3 is rising and higher than a threshold potential of the first switch device DD1, it would activate the second electric-controlled switch Q2 and turn on the discharging lamp 99.

In maintaining procedure, a potential of the maintain/turn-off sub-unit 46 at contact F is acted by the fourth capacitance C4 and the first diode D1, and is multiplied and rectified by the first zener ZD1 and the rectification unit 21, and is filtered by the fifth capacitance C5 that it generates a standard level potential at contact A. In the present invention, it is −43 voltages. After the current is rectified by the rectification unit 21, it will flow to the contact C through the third resistor C3 and the second diode C2. When the potential at contact C is greater than 43 voltages, the second zener diode ZD2 is activated. The potentials at the contact D and the contact A are divided by the fourth and fifth resistors R4 and R5 that the potential at the contact D is less than the threshold potential of the second switch device DD2. As a result, the second switch device DD2 is unactivated and the second electric-controlled switch Q2 will keep its current working.

In turn-off procedure, when user operates the standard dimmer to gradually lower the potential, the current, after being rectified by the rectification unit 21, flows through the contact B the third resistor R3 and the second diode D2 of the maintain/turn-off sub-unit 46 in sequence. When the potential at the contact C is lower than 43 voltages, the potential at the contact A divided by the fourth resistor R4 and the fifth resistor R5 will charge the sixth capacitance C6 at contact D. When the potential of the sixth capacitance C6 is greater than a threshold potential of the second switch device DD2, the second switch device DD2 activated, and a negative potential will turn off the second electric-controlled switch Q2 that will turn off the discharging lamp 99.

The present invention further includes a load selection unit 51 having a third electric-controlled switch Q3, a seventh resistor R7, a load resistor Rload, and an eighth resistor R8. The load selection unit 51 is connected to the maintain/turn-off sub-unit 46 to turn off the third electric-controlled switch Q3 and cut off the current through the load resistor Rload when the discharging lamp 99 is turned on. The third electric-controlled switch Q3 will be turned on to have a current flowing through the load resistor Rload when the discharging lamp 99 is turned off and still has a low current flowing therethrough.

That is, when the discharging lamp 99 is turned on, the standard potential of the contact A is −43 voltages that it will turn off the third electric-controlled switch Q3 through the eighth resistor R8, and on current flows through the load resistor Rload.

When the discharging lamp 99 is turned off and still has a low current flowing therethrough, such as user operates the standard dimmer to a very low potential, the current flows through the seventh resistor R7 via the contact B to turn on the third electric-controlled switch Q3 that the current at contact B will flow through the load resistor Rload and the third electric-controlled switch Q3 to the ground.

With that, the load selection unit 51 lets no current flowing through the load resistor Rload when the discharging lamp 99 is lighting and let the current flowing through the load resistor Rload when the discharging lamp 99 is turned off and still has a low current flowing therethrough. It will have no power waste problem.

In conclusion, the functions and advantages of the present invention are:

1. The present invention may turn off the discharging lamp in a low power condition to avoid flash problem.

The present invention provides the same work as the conventional device in the starting and maintaining procedures. As long as the power is dimmed very lower, or even off, the present invention will cut off the current flowing to the discharging lamp to avoid the problem of discharging lamp flashing in a low power condition.

2. The present invention has a simple structure and lower cost.

No IC or microprocessor is involved in the present invention. The present invention only has a few conventional electronic devices that are very cheap. Furthermore, the circuit of the present invention is not complex also.

3. The present invention needs less power than the conventional device.

The load selection unit of the present invention lets no current flowing through the load resistor when the discharging lamp is lighting. In the condition of the discharging lamp not lighting and a very low current flowing therethrough, the load selection unit lets current flowing through the load resistor. It will not waste the power when the discharging lamp is lighting.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A dimming circuit for a discharging lamp, comprising:

a resonant unit including a first capacitance and a second capacitance in series, and a first inductance in parallel with said first capacitance and second capacitance;

a rectification unit connected to said resonant unit to transfer an AC power to a DC power;

a half-bridge output unit, which is connected to a discharging lamp, including a first electric-controlled switch and a second electric-controlled switch in series, wherein said first electric-controlled switch and said second electric-controlled switch are in series with said rectification unit, and have a control terminal respectively;

a first switch device and a second switch device connected to said control terminals of said first electric-controlled switch and said second electric-controlled switch respectively; and a selection unit including a start sub-unit and a maintain/turn-off sub-unit, wherein said start sub-unit is connected to said rectification unit and said first switch device to turn on said first switch device and said second electric-controlled switch when a potential is rising that turns on said discharging lamp, and said maintain/turn-off sub-unit is connected to said rectification unit and said second switch device to turn off said second switch device and keep turning on said second switch device when said discharging lamp is lighting, and said maintain/turn-off sub-unit further turns on said second switch device to turn off said second electric-controlled switch for turning off said discharging lamp when said potential is lower than a predetermined value.

2. The dimming circuit as claimed in claim 1, wherein said start sub-unit includes a first resistor, a second resistor, and a third capacitance, and said maintain/turn-off sub-unit includes a fourth capacitance, a first diode, a first zener diode a fifth capacitance, a third resistor, a second diode, a second zener diode, a fourth resistor, a fifth resistor, and a sixth capacitance.

3. The dimming circuit as claimed in claim 2, wherein said rectification unit is a full-wave rectification circuit.

4. The dimming circuit as claimed in claim 2, wherein each of said control terminals of said first electric-controlled switch and said second electric-controlled switch is connected to an oscillation unit respectively, and each of said oscillation unit is a RL oscillator including a resistor and an inductance in series.

5. The dimming circuit as claimed in claim 2, wherein said first switch device and said second switch device are diode AC switches.

6. The dimming circuit as claimed in claim 2, further comprising a load selection unit including a third electric-controlled switch, a seventh resistor, a load resistor, and an eighth resistor, wherein said load selection unit is connected to said maintain/turn-off sub-unit to turn off said third electric-controlled switch and cut off a current through said load resistor when said discharging lamp is turned on, and let a current flowing through said load resistor when said discharging lamp is turned off and still has a low current flowing therethrough.

* * * * *